US006735826B2

(12) United States Patent
Uehara et al.

(10) Patent No.: US 6,735,826 B2
(45) Date of Patent: May 18, 2004

(54) BUCKLE

(75) Inventors: Ryoichiro Uehara, Tokyo (JP); Shinichiro Kinebuchi, Tokyo (JP); Yoshinobu Takahashi, Uozu (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/391,114

(22) Filed: Mar. 18, 2003

(65) Prior Publication Data

US 2003/0172499 A1 Sep. 18, 2003

(30) Foreign Application Priority Data

Mar. 18, 2002 (JP) ..... 2002-074433

(51) Int. Cl.[7] ..... A44B 11/12

(52) U.S. Cl. ..... 24/170; 24/68 CD; 24/171; 24/191; 24/194; 24/265 CD

(58) Field of Search ..... 24/170, 171, 191, 24/194, 163 R, 68 CD, 265 CD, 265 BC

(56) References Cited

U.S. PATENT DOCUMENTS

| | | | | | |
|---|---|---|---|---|---|
| 300,303 | A | * | 6/1884 | Butler | 24/170 |
| 330,213 | A | * | 11/1885 | Deweese | 24/170 |
| 3,328,856 | A | * | 7/1967 | Jonas | 24/191 |
| 3,402,439 | A | * | 9/1968 | Currat | 24/194 |
| 4,727,628 | A | * | 3/1988 | Rudholm | 24/170 |
| 4,843,688 | A | * | 7/1989 | Ikeda | 24/170 |
| 6,219,889 | B1 | * | 4/2001 | Lovato et al. | 24/170 |
| 6,560,825 | B2 | * | 5/2003 | Maciejczyk | 24/170 |

FOREIGN PATENT DOCUMENTS

| | | |
|---|---|---|
| JP | 4-9841 | 3/1992 |
| JP | 5-31926 | 8/1993 |

* cited by examiner

*Primary Examiner*—Victor Sakran
(74) *Attorney, Agent, or Firm*—Bell, Boyd & Lloyd LLC

(57) ABSTRACT

Provided is a buckle which comprises a buckle main body 11 and an engagement member 31. The buckle main body 11 comprises a base part 12, at least two insertion holes 18 and 19 provided on the base part 12 with a space in between, to which a belt 2 is inserted, and an upstanding piece 20 provided therebetween for bending the belt 2 in a direction away from the base part 12. The engagement member 31 can be moved to a first position where the buckle can be moved against the belt 2 and to a second position where the buckle can be fixed to the belt 2. Further, the engagement member 31 comprises a pressurizing part 33 for pressurizing the belt 2 in the second position so as to obtain a further bent state and an adjustor 35 capable of adjusting the length of the other belt 3.

10 Claims, 9 Drawing Sheets

BUCKLE

BACKGROUND OF THE INVENTION

1. Field of the Invention

The present invention relates to a buckle and, more specifically, to a buckle which can be moved in the longitudinal direction of a web-like material (e.g. a tape, a belt or a flat strap) and also can be fixed in an optional position.

2. Description of Related Art

As a buckle capable of being moved in the longitudinal direction of a web-like material and being fixed in an optional position, which comprises a first member and a second member displaceably provided in the first member, for example, a buckle disclosed in Japanese Utility Model Application Laid-open H5-31926 (Conventional Example 1) or Japanese Utility Model Application Laid-open H4-9841 (Conventional Example 2) is well-known.

The buckle of the Conventional Example 1 comprises a buckle main body and a stopper piece. The buckle main body comprises a pair of side frames, an attachment shaft provided over one edge between a pair of the side frames, a winding shaft provided over the other end between the pair of side frames and a guide shaft. One end of the stopper piece is rotatably supported in between the side frames on the attachment shaft side. Further, the stopper comprises an engagement protrusion on the other end for fastening a belt between with the winding shaft.

In this structure, one of the belts is attached to the attachment shaft. After winding the other belt around the winding shaft and reversing it, the engagement protrusion of the stopper piece is pushed into the reversed face of the belt. Thereby, the reversed face of the belt is engaged with the winding shaft by pressure in the side face of the engagement protrusion. That is, the belt is engaged with the buckle in an optional position in the longitudinal direction.

The buckle of the Conventional Example 2 comprises a buckle main body and a stopper. The buckle main body comprises a pair of side frames, a pair of bearing grooves formed on one end of the pair of side frames, a winding shaft and a guide shaft provided over the other end between the pair of side frames. The stopper piece comprises a protrusion shaft which is engaged with the winding shaft provided on one end and the bearing grooves, and an engagement protrusion provided in the other end for fastening the belt between with the winding shaft.

In this structure, one of the belts is attached to the attachment shaft. After winding the other belt around the winding shaft and reversing it, the engagement protrusion of the stopper piece is pushed into the reversed face of the belt. Thereby, the reversed face of the belt is engaged with the winding shaft by pressure in the side face of the engagement protrusion. That is, the belt is engaged with the buckle in an optional position in the longitudinal direction.

However, both buckles described above have the structure which prevents shift of the belt by pinching the belt between the engagement protrusion of the stopper piece and the winding shaft. Thus, it is necessary to precisely fabricate the buckles so that, when the stopper is rotated, the space between the engagement protrusion of the stopper piece and the winding shaft becomes smaller than the thickness of the belt by appropriate amount. Therefore, it becomes necessary to fabricate each part with high precision thereby increasing the cost. If the space between the engagement protrusion of the stopper piece and the winding shaft is not smaller than the thickness of the belt by appropriate amount, there may face following problems.

For example, if the space between the engagement protrusion of the stopper piece and the winding shaft is extremely smaller than the thickness of the belt, it requires a force to rotate the stopper piece. Thus, the force is applied to the stopper piece and the buckle main body which rotatably supports the stopper. Therefore, these parts are likely to be damaged.

Inversely, if the space between the engagement protrusion of the stopper piece and the winding shaft is extremely larger than the thickness of the belt, the force for pinching the belt becomes insufficient so that the shift of the belt cannot be surely prevented.

Further, when being repeatedly used for a long period of time, it is possible that the engagement protrusion of the stopper becomes slippery due to wear. Therefore, the shift of the belt cannot be surely prevented. In other words, it is likely to cause deterioration in the fixing function due to wear.

SUMMARY OF THE INVENTION

The present invention has been designed to overcome the foregoing problems. An object of the present invention is to provide a buckle in which each part is not required to be fabricated with high precision, which is capable of moving and fixing by simple operation, suffers less damage for a long period of time and, at the same time, is capable of preventing the deterioration in the fixing function.

A buckle of the present invention comprises a first member and a second member which is provided displaceable in the first member. The first member comprises a base part, at least two insertion parts provided in the base part with a space in between to which the web-like material is inserted, and a bending part provided in between the two insertion parts for bending the web-like material in a direction away from the base part. The second member is displaceable to a first position where the buckle can be moved against the web-like material and to a second position where the buckle can be fixed to the web-like material, and comprises a pressurizing part for pressurizing one side of the web-like material in a bent state towards the other side so as to obtain a further bent state in the second position.

When pressurizing one side of the bent web-like material towards the other side thereby to further bend it, the web-like material may come to be in contact with the bent part and the pressurizing part. However, it is not necessary that the web-like material be fastened by a strong force being pinched between the bent part and the pressurized part as long as the bent state of the web-like material serves as resistance to the shift of the buckle thereby to restrict the shift of the buckle.

In this structure, the web-like material, for example, is pulled out from one of the insertion part via the bending part, after being inserted to the other insertion part. When the second member is placed in the first position, the buckle is in a movable state against the web-like material so that the buckle can be moved to an optional position of the web-like material in the longitudinal direction. In the case of moving the web-like material against the buckle, the web-like material can be moved against the buckle in the longitudinal direction.

When moving the second member to the second position, the pressurizing part of the second member pressurizes the one side of the bent web-like material towards the other side thereby to further bend it. Thus, the shift of the buckle against the web-like material is restricted so that the buckle can be fixed in an optional position of the web-like material in the longitudinal direction.

As described, it is a structure that the buckle is fixed by the pressurizing part of the second member, which pressurizes one side of the bent web-like material towards the other side so as to further bent the web-like material. In other words, it is not a structure in which the buckle is fixed through fastening the web-like material by a strong force being pinched between the bent part and the pressurizing part. Therefore, unlike the related art, it is not necessary to fabricate each part with high precision. Further, because of the same reason, that is, it is not the structure in which the buckle is fixed through fastening the web-like material by a strong force being pinched between the bent part and the pressurizing part, moving and fixing operations of the buckle can be easily performed. Also, it suffers less damage for a long period of time and, at the same time, prevents the deterioration in the fixing function.

In the buckle of the present invention, the bending part is composed of an upstanding piece which stands sloping up towards a direction away from the base part as it reaches the other insertion part from the base part in the vicinity of one of the insertion parts. The pressurizing part, in the second position, is to be substantially in the same position as a perpendicular line drawn from the tip of the upstanding piece to the base part or to be protruded to inner side of the upstanding piece than the perpendicular line.

In this structure, when the second member is in the second position, the pressurizing part is in substantially the same position as the perpendicular line drawn from the upstanding piece or protruded inner side of the upstanding piece than the perpendicular line. Therefore, the web-like material is to be bent in Z-shape or reversed S-shape so that the shift of the buckle can be more surely restricted.

Further, it is preferable that the upstanding piece stand up sloping against the base part at an angle of 35° to 55°.

In this structure, the upstanding piece stands up sloping against the base part at an angle of 35° to 55° so that the thickness of the buckle can be suppressed while maintaining the function of restricting the shift of the buckle. In other words, if the angle of the upstanding piece is increased, bending height of the web-like material from the base part (that is, rising height) is also increased, thereby increasing the resistance at the time of moving the buckle. Therefore, the function of restricting the shift of the buckle is improved while the thickness of the buckle is increased. Inversely, if the angle of the upstanding piece is reduced, the thickness of the buckle can be decreased while the function of restricting the shift of the buckle is deteriorated. On the contrary, by providing the upstanding piece at an angle within the above-described range against the base part, both functions described above can be sufficiently achieved.

Further, it is preferable that the tips of the upstanding piece and the pressurizing part be formed at an angle of 90° or less.

In this structure, both tips of the upstanding piece and the pressurizing part with which the bent web-like material is to be in contact are formed at an angle of 90° or less. Therefore, the corners of the tips are to be engaged with the web-like material so that the function of restricting the shift of the buckle can be further improved.

Also, it is preferable that the second member be rotatably supported by the base part in between the two insertion parts of the first member.

With this structure, the second member can be easily moved between the first position and the second position by simply rotating it. Thus, the operation can be easily and smoothly performed.

Further, it is preferable that the second member comprise a pinching part for pinching the web-like material between with the base part of the first member when the second member comes to be in the second position.

With this structure, when the second member is in the second position, the web-like material is further bent by the pressurizing part of the second member and, at the same time, it is pinched between the pinching part of the second member and the base part of the first member. In other words, the resistance between the web-like material and the buckle is further increased. As a result, the function of restricting the shift of the buckle can be further improved.

Furthermore, it is preferable that the second member comprises a length adjustor capable of restricting shift of the inserted other web-like material in an optional position in a length direction, to which other web-like material than the web-like material is inserted.

With this structure, moving and fixing operation of the buckle in an optional position of the web-like material in the longitudinal direction and adjusting the length of the other web-like material can be achieved by one buckle. Therefore, when it is applied to the conventional rucksack structure, the number of parts can be reduced, thereby reducing the cost while improving the operability.

FIG. 8 and FIG. 9 show the conventional rucksack structure. The rucksack comprises a rucksack main body 1, a pair of carrying belts 2 provided on both sides of shoulder part of the rucksack main body 1, and a support belt 3 for connecting the upper part of the carrying belts 2 and the upper part of the rucksack main body 1. The carrying belts 2 comprises two belts 2A and 2B whose one ends are fixed to the rucksack main body 1, and a connector 2C for connecting the ends of the two belts 2A and 2B while enabling to adjust the length of the belt 2B. The support belt 3 comprises two belts 3A and 3B, a connector 3C for connecting the ends of the two belts 3A and 3B while enabling to adjust the length of the belt 3A, and a connector 3D which is provided movable in the longitudinal direction of the belt 2A and connects to the other end of the belt 3A.

With this structure, it requires three connectors such as the connector 2C, the connector 3C and the connector 3D. That is, a large number of parts are required thereby increasing the cost. Also, the adjusting operation needs to be performed in each position of the connectors 2C, 3C, and 3D. In other words, operation needs to be performed in three different positions resulting in lack of operability.

The structure of the present invention is designed to overcome such a problem. In other words, when the buckle according to the present invention, which comprises, in the second member, a length adjustor capable of restricting shift of other inserted web-like material in an optional position in a length direction, to which other web-like material different form the web-like material is inserted, is employed, for example, in the position of the connector 3D in FIG. 8 and FIG. 9, reduction in the number of the parts and cost, and improvement in the operability can be expected. In other words, by employing the structure of the present invention to the rucksack structure shown in FIG. 8 and FIG. 9, the connector 3C can be omitted and, at the same time, operation is required only in two positions such as in the connector 2C and the buckle of the present invention. Thus, the operability can be more improved compared to the related art.

Further, it is preferable that the length adjustor be composed of at least two insertion parts provided in the second member with a space in between in a longitudinal direction of the other web-like material, to which the other web-like material is inserted.

With this structure, the other web-like material can be fixed in a position of an optional length through inserting the web-like material into one of the insertion part, reversing it then to be inserted into the other insertion part, and then pulling it out to the initial position side of the web-like material.

Furthermore, it is preferable that at least one corner of cross section in a part between the two insertion parts formed in the second member be an acute angle.

In this structure, at least one corner of the cross section in a part between the two insertion parts to which the other web-like material is inserted is formed to be at an acute angle. Therefore, the acute angle part of the tip is to be engaged with the web-like material so that the other web-like material can be surely fixed in a position of an optional length.

DETAILED DESCRIPTION OF THE PREFERRED EMBODIMENTS

An embodiment of the present invention will be described in the followings by referring to accompanying drawings.

Figure 1:
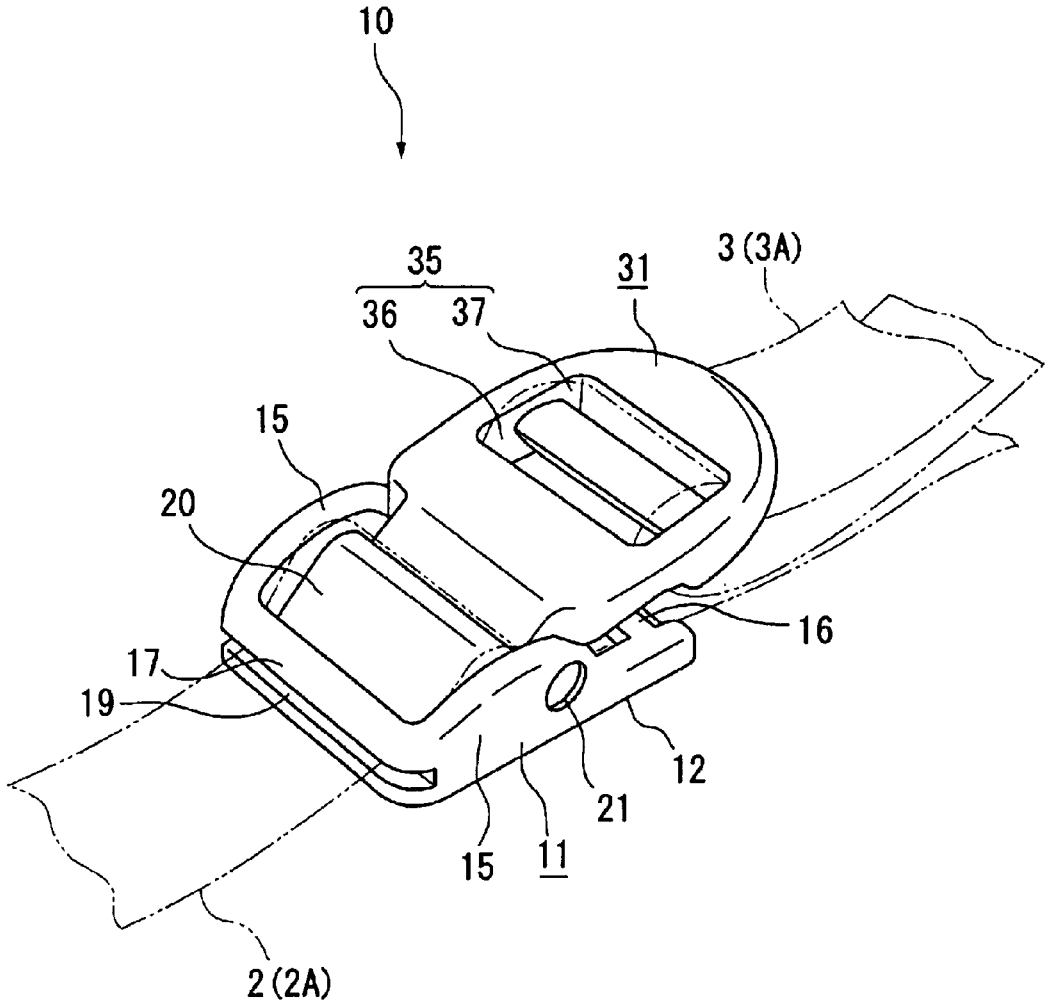
FIG. 1 is a perspective view showing a buckle according to an embodiment (fixed state) of the present invention.
Figure 2:
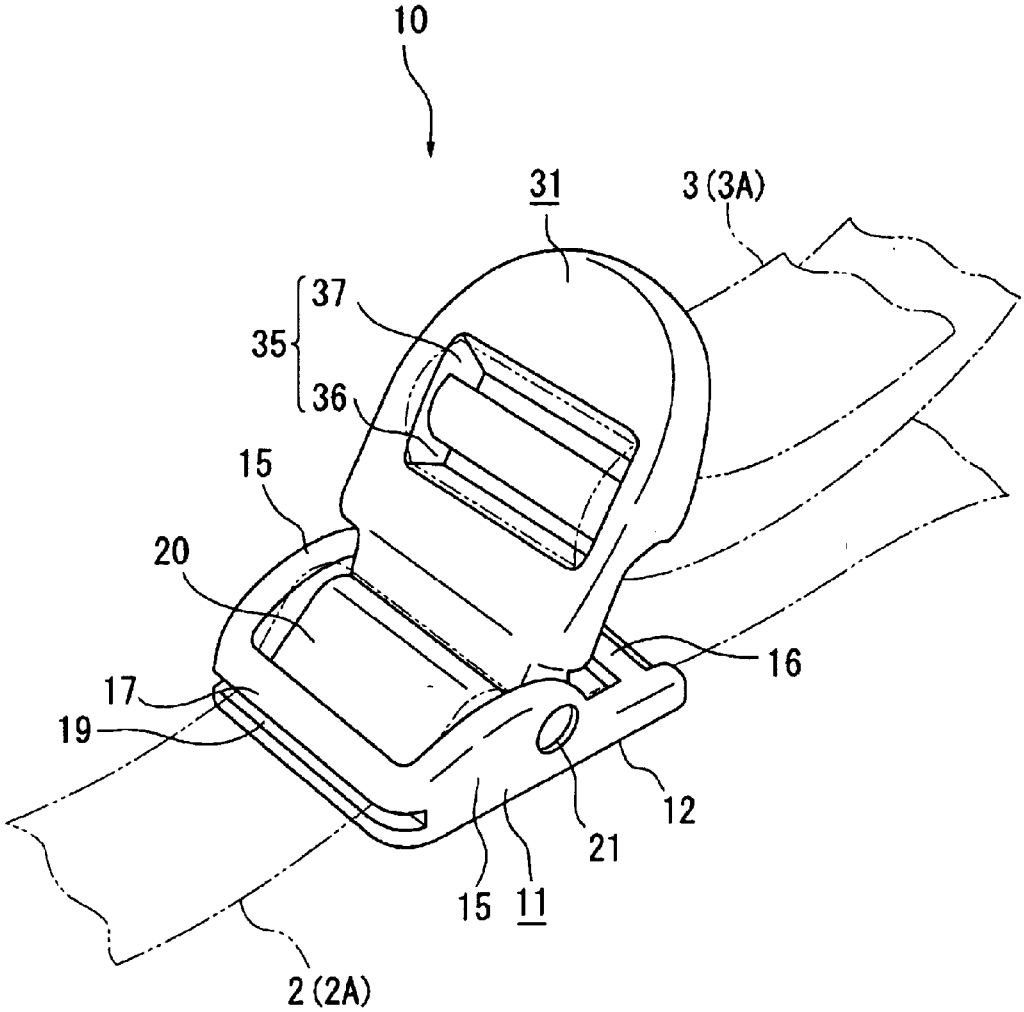
FIG. 2 is a perspective view showing a released state of the embodiment.
Figure 8:
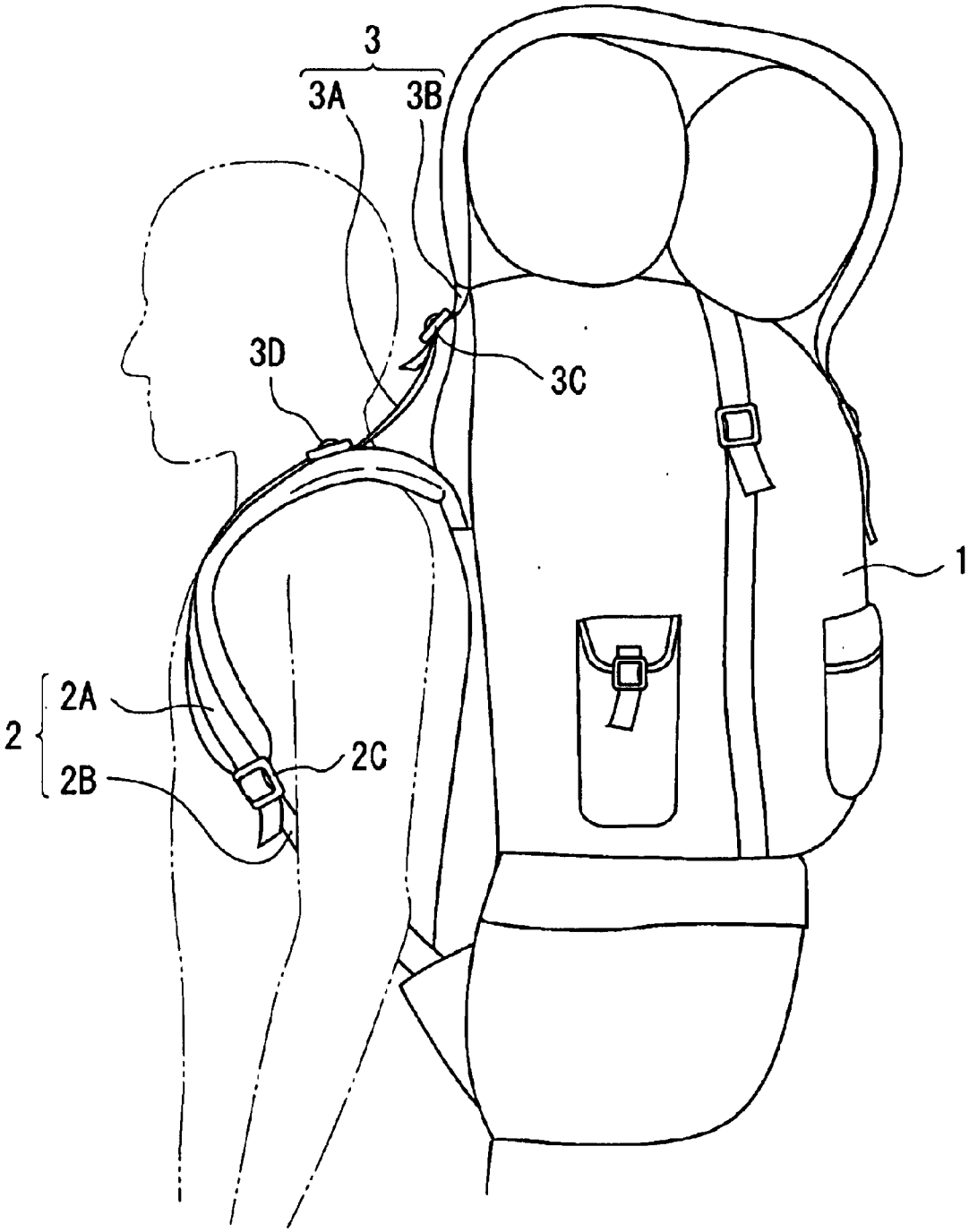
FIG. 8 is an illustration showing the structure of a rucksack.
Figure 9:
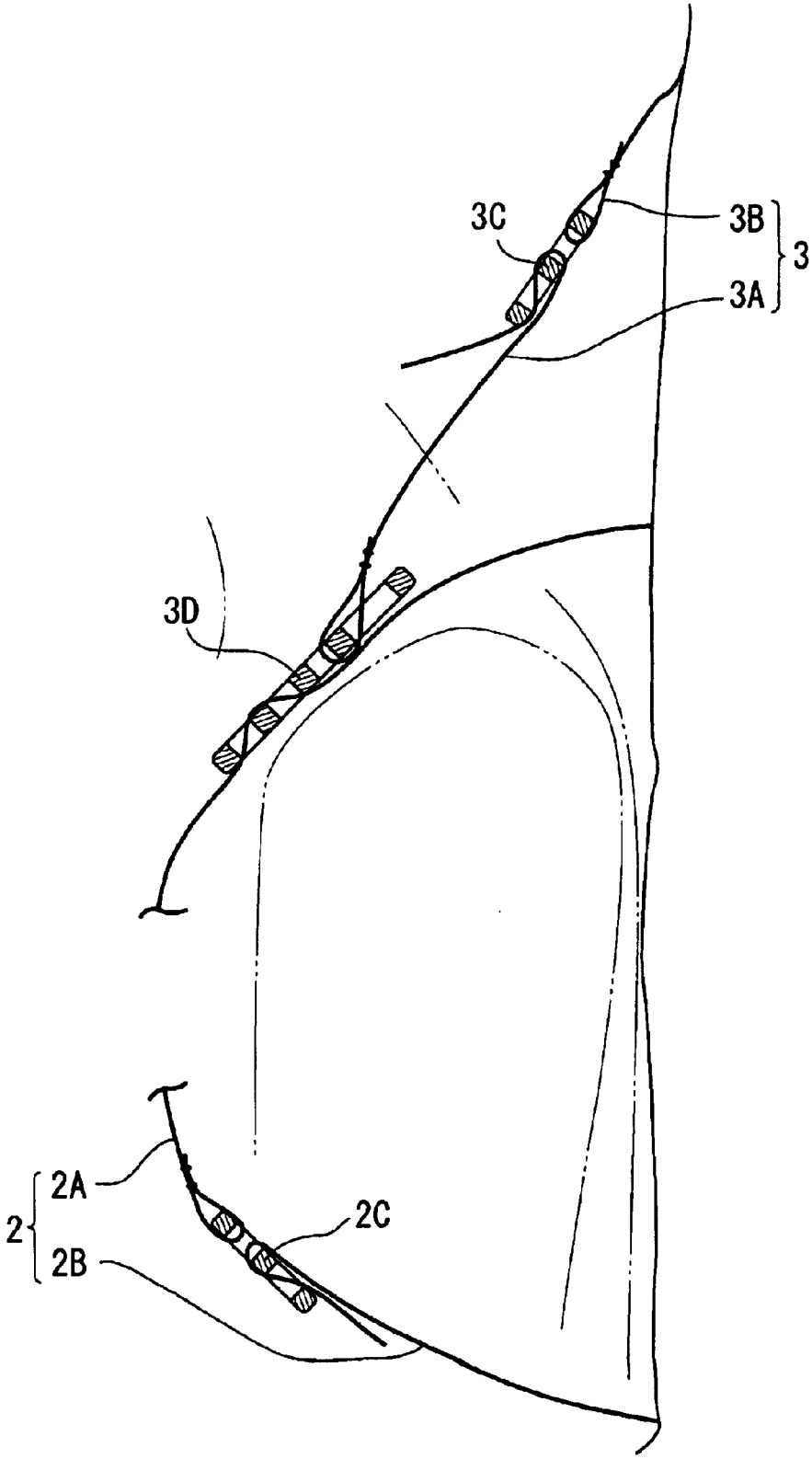
FIG. 9 is an illustration showing the connected state of a belt in the rucksack structure shown in FIG. 8.

FIG. 1 and FIG. 2 show a buckle 10 (in a fixed state and released state) of the embodiment. The buckle 10 is applied to a connector 3D in the above-described rucksack structure shown in FIG. 8 and FIG. 9. The buckle 10 comprises functions of being moved in the longitudinal direction of a belt 2 (2A) as a web-like material and being fixed in an optional position, and a function of adjusting the length of a belt 3 (3A) as a web-like material. Used as the belts 2 and 3 are strap bodies with rigidity to some extent and a prescribed width made of synthetic resin yarn (e.g., polyester, polypropylene, acryl) in a form of plain weave, point twill weave, grosgrain weave, basket weave, modified basket weave or the like.

Figure 3:
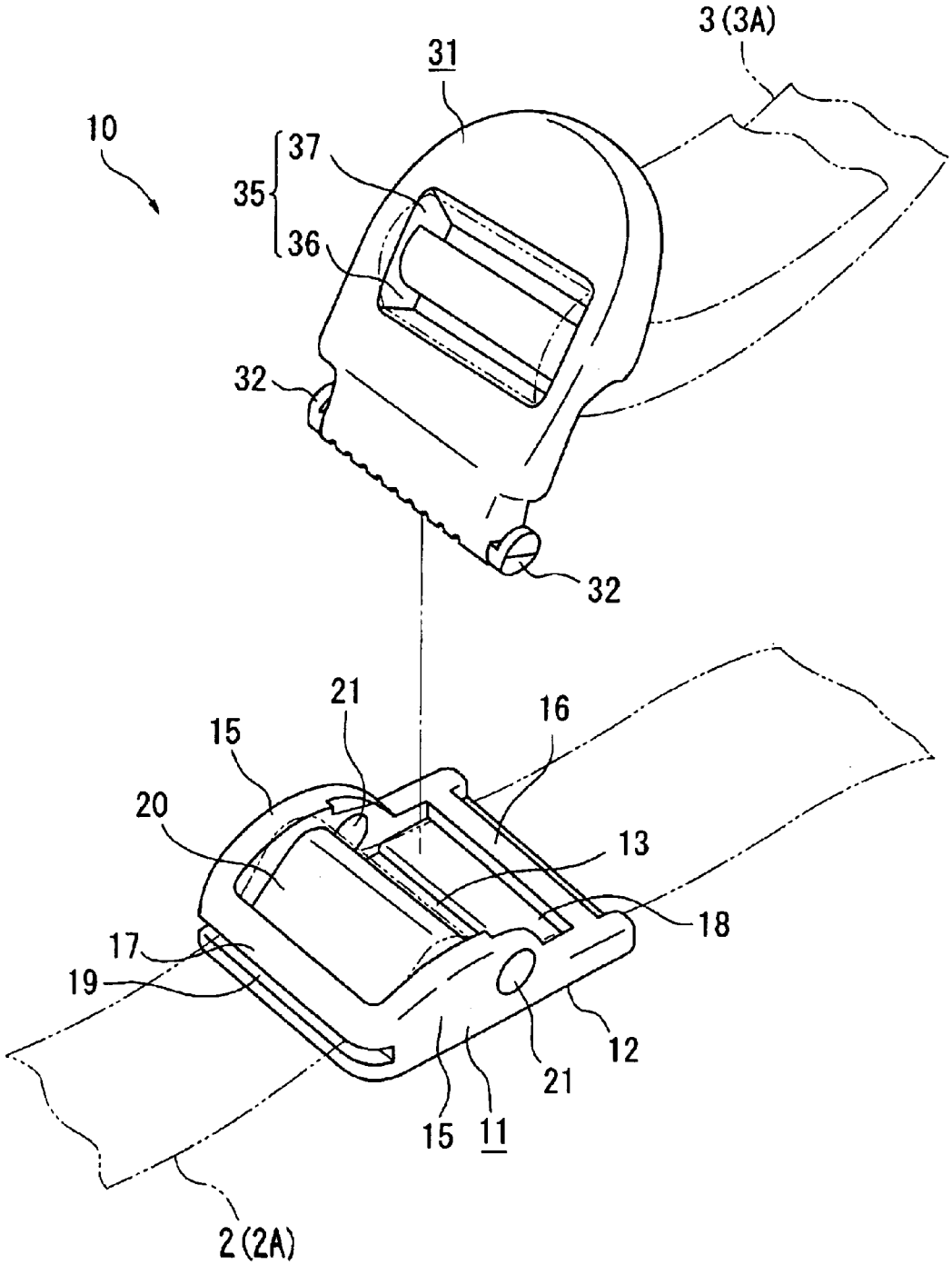
FIG. 3 is an exploded perspective view of a buckle main body and an engagement member of the embodiment.
Figure 4:
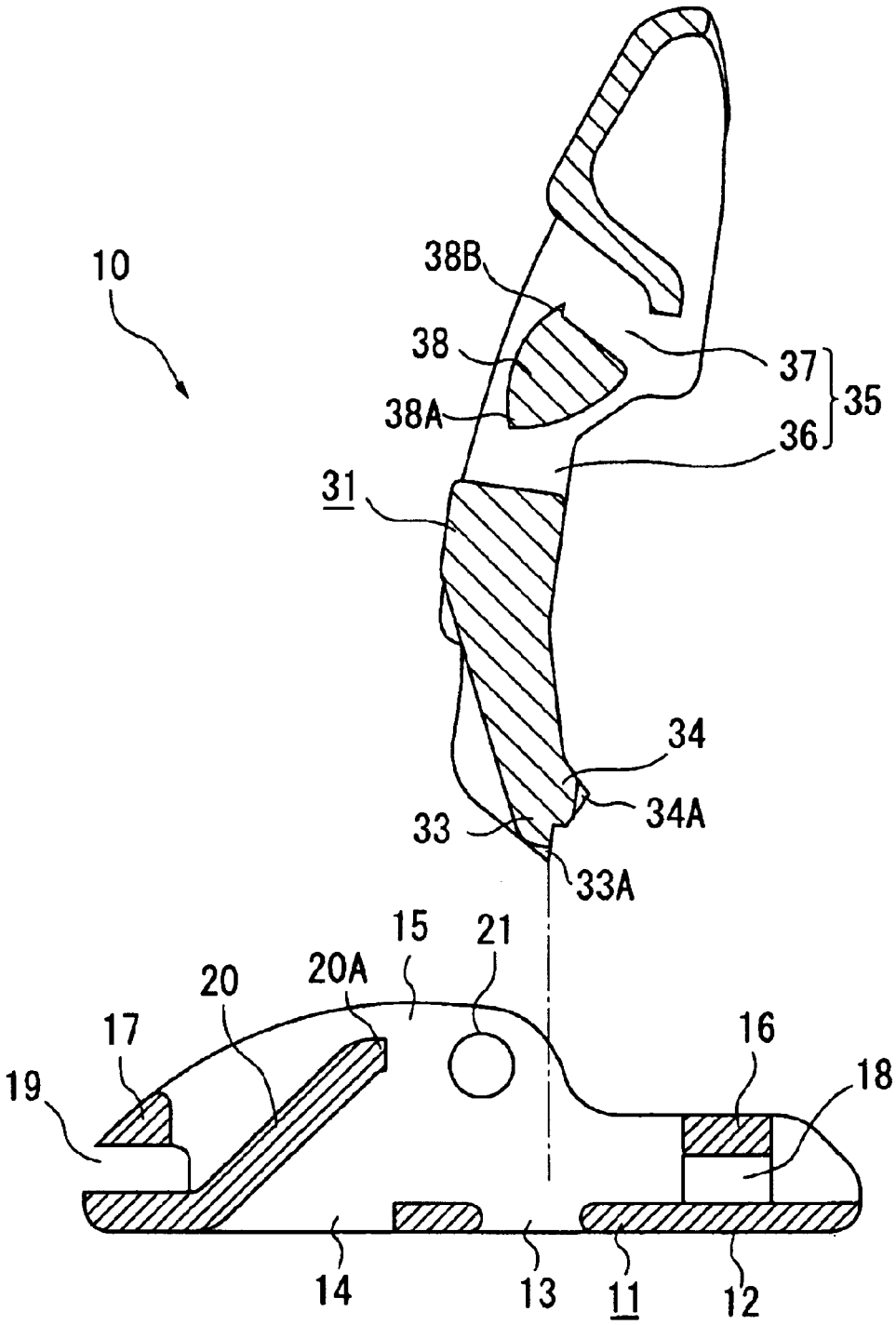
FIG. 4 is a cross section of the buckle main body and the engagement member of the embodiment.

The buckle 10 of the embodiment comprises, as shown in FIG. 3 and FIG. 4, a buckle main body 11 as a first member formed by ejection molding a synthetic resin and an engagement member 31 as a second member which is provided in the buckle main body 11 to be movable, that is, to be rotatable.

The buckle man body 11 comprises a base part 12 in a rectangular shape with long sideways and a pair of sidewalls 15 provided on both sides of the base part 12 in the width direction.

Two through holes 13 and 14 are formed in the intermediate position in the longitudinal direction of the base part 12 with a space in between in the inserting direction of the belt 2.

In between the pair of sidewalls 15, connecting bars 16 and 17 are provided over both ends. Also, an upstanding piece 20 as a bending part is formed on one end for bending the belt 2 in the direction away from the base part 12 while a bearing hole 21 is formed in the center part. In between the connecting bars 16, 17 and the base part 12, insertion holes 18 and 19 as insertion part to which the belt 2 is inserted are provided in the longitudinal direction of the belt 2 with a space in between. The upstanding piece 20 is provided to stand sloping up towards the direction away from the base part 12 as it reaches from the base part 12 in the vicinity of one of the insertion hole 19 to the other insertion hole 18. In the embodiment, it is formed to slope against the base part 12 at an angle of 35° to 55° and, at the same time, the tip 20A is formed to be at an angle of about 90° or less.

The engagement member 31, in between the two insertion holes 18 and 19 of the buckle main body 11, is engaged with the bearing hole 21 of the sidewall 15. Also, it is provided to be rotatable to the first position (the position in FIG. 2) where the buckle 10 can be moved against the belt 2, and to the second position (the position in FIG. 1) where the buckle 10 can be fixed to the belt 2.

An engagement member 31 comprises a protrusion 32 to be rotatably engaged with the bearing hole 21, a pressurizing part 33 for pressurizing one side of the belt 2 in a bent state towards the other side so as to further bent it when being in a second position, a pinching part 34 for pinching the belt 2 between with the base part 12 of the buckle main body 11, and a length adjustor 35 to which a belt 3 is inserted and which is capable of restricting the shift of the belt 3 in an optional position in the longitudinal direction.

The pressurizing part 33, when the engagement member 31 is at the second position, is to be at substantially the same position as a perpendicular line drawn from the tip of the upstanding piece 20 or protruded inner side of the upstanding piece 20 than the perpendicular line. Its tip 33A is formed to be at an angle of 90° or less (about 60° in the embodiment) and comprises grooves (dents and protrusions) formed in the positions at constant intervals in the width direction.

The pinching part 34 comprises a function of pinching the belt 2 between with the base part 12 of the buckle main body 11 when the engagement part 31 is in the second position. Also, its tip 34A is formed in the corner and comprise grooves (dents and protrusions) formed in the positions at constant intervals in the width direction.

The length adjustor 35 is composed of at least two insertion parts, that is, insertion holes 36 and 37 provided in the engagement member 31 with a space in between in the longitudinal direction of the belt 3, to which the belt 3 is inserted. At least one of the cross section of intermediate part 38 in between two insertion holes 36 and 37 is at an acute angle. Specifically, the outer surface and the inner surface of the intermediate part 38 are curved in an arc form so that the surfaces approach towards each other from the insertion hole 37 to the insertion hole 36. That is, it is formed in a bullet-like form and two corners 38*a* and 38B are formed to be at an acute angle.

Figure 5:
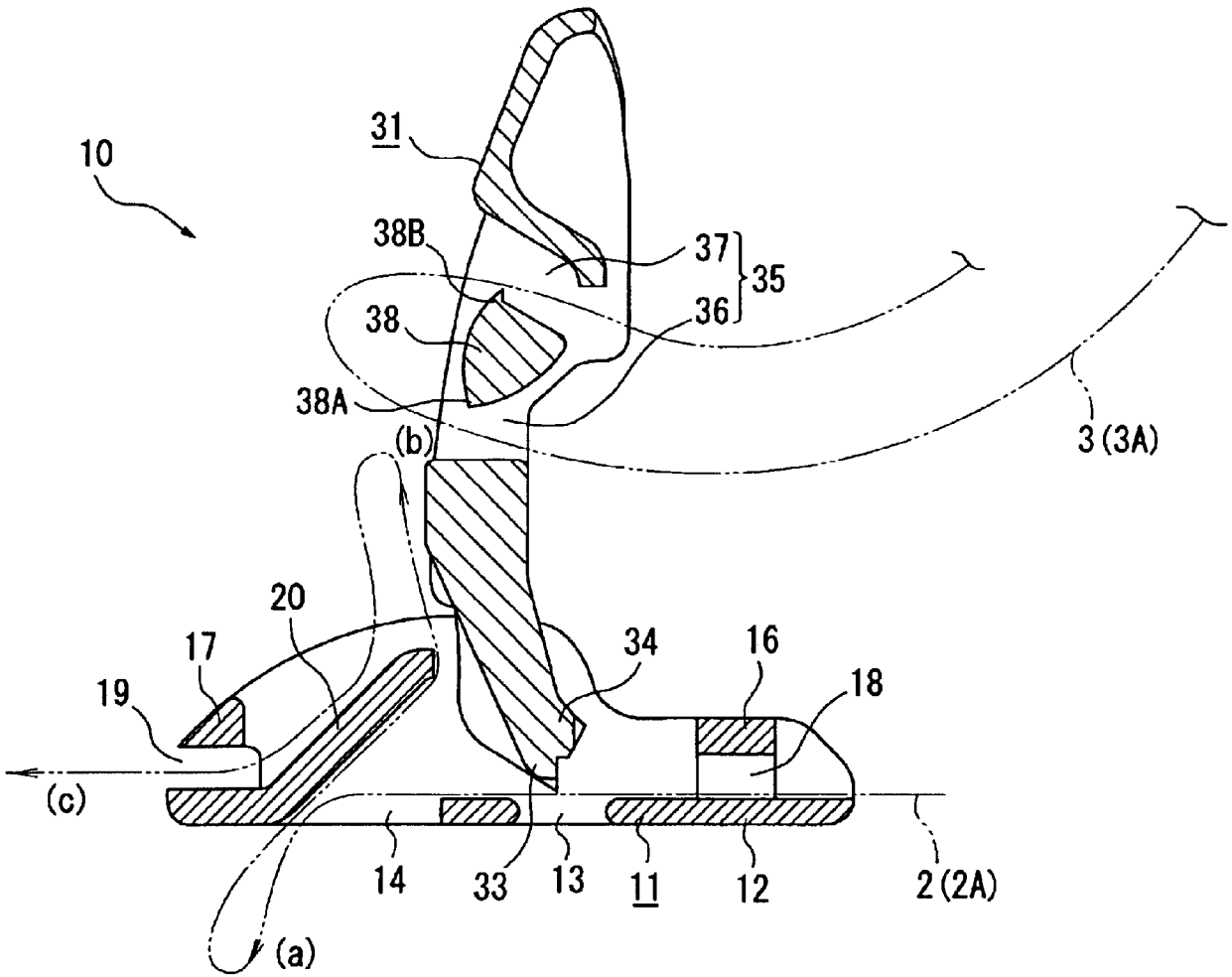
FIG. 5 is a cross section showing the released state of the embodiment.

In the structure described above, the belts 2 and 3 are inserted into the buckle 10 in a procedure shown in FIG. 5.

When inserting the belt 2, it is inserted into the insertion hole 18 of the buckle main body 11 and then is further pushed therethrough. Thus, the tip of the belt 2 comes to be in contact with the inner surface of the upstanding piece 20. Then, it is protruded from the through hole 14 to the back surface side of the base part 12 along the slope of the upstanding piece 20 (see A).

After reversing the tip of the belt 2 which is protruded to the back surface side of the base part 12, the tip of the belt 2 is pushed along the inner surface of the upstanding piece 20. The tip of the belt 2 is thus brought along the inner surface of the upstanding piece 20 and is protruded to the surface side of the buckle 10 from the space between the upstanding piece 20 and the engagement member 31 (see B).

At last, the tip of the belt 2 which is protruded to the surface side of the buckle 10 is reversed and then is pushed along the outer surface of the upstanding piece 20. Thereby, the tip of the belt 2 is brought along the outer surface of the upstanding piece 20 so as to be protruded to the other end side through the insertion hole 19 (see C). Thereby, the belt 2 is inserted to the buckle 10.

When inserting the belt 3, it is inserted to the insertion hole 36 from the inner surface side of the engagement member 31. Then, the tip is reversed and inserted to the insertion hole 37 from the outer surface side of the intermediate part 38. It is then pulled out from the inner side surface of the engagement member 31. Thereby, the belt 2 is inserted to the buckle 10.

When the belts 2 and 3 are inserted to the buckle 10 in the manner as described, when the engagement member 31 is in the state shown in FIG. 2, that is, in the first position, the belt 2 inside the buckle 10 is in the state with its center being gently bent in a mountain-like form so that the force of restricting the shift of the buckle 10 is not great. Therefore, through applying a force to the buckle 10 in the longitudinal direction of the belt 2 in this state, the buckle 10 can be moved in the longitudinal direction of the belt 2.

Figure 6:
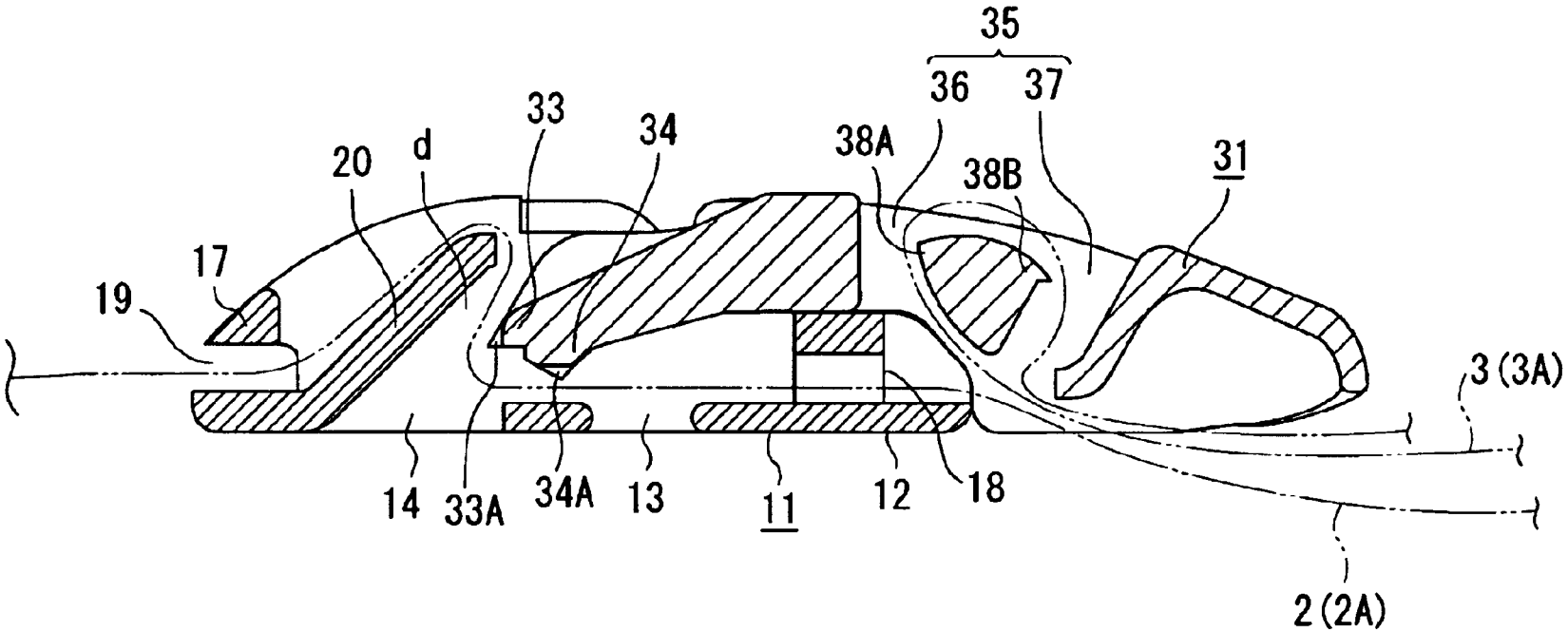
FIG. 6 is a cross section showing the fixed state of the embodiment.

After moving the buckle 10 to an optional position of the belt 2 in the longitudinal direction, the engagement member 31 is brought into the state shown in FIG. 1, that is, rotated to the second position, the pressurizing part 33 of the engagement member 31, while being rotated, is protruded to the inner side of the upstanding piece 20 than the perpendicular line drawn from the tip of the upstanding piece 20 to the base part 12. Thereby, as shown in FIG. 6, one of the sides of the mountain-like form of the belt 2 which is gently bent in a mountain-like form inside the buckle 10 is further pushed towards the inner side to be in a further bent state. That is, the tip of the belt 2 is wound along the outer surface of the slope of the upstanding piece 20 and then is further wound around the pressurizing part 33 of the engagement member 31. Thus, this part is to be bent in S-shape or Z-shape. As a result, shift of the buckle 10 is restricted so that the buckle 10 can be fixed in an optional position of the belt 2 in the longitudinal direction. When the belt 2 is bent in S-shape or Z-shape, there is a space d formed between the belt 2 and the inner surface of the upstanding piece 20.

On the other hand, in the case where the length of the belt 3 is required to be adjusted, before fixing the buckle 10 to the belt 2, that is, in the state where the engagement member 31 is placed in the first position, length of the belt 3 is adjusted. Then, the engagement member 31 is rotated to the state shown in FIG. 1, that is, to the second position.

When adjusting the length of the belt 3, the tip side (opposite side to the fixed end side) of the belt 3 is pushed into the length adjustor 35 of the engagement member 31 and the fixed end side of the belt 3 is pulled out from the length adjustor 35 of the engagement member 31 (for extension), or the fixed end side of the belt 3 is pushed into the length adjustor 35 of the engagement piece 31 and the tip side of the belt 3 is pulled out from the length adjustor 35 of the engagement member 31 (for extension). Thereby, the length from the fixed end of the belt 3 to the buckle 10 is adjusted to an optional length.

With the embodiment, following effects are achieved.

(1) It has such a structure that the pressurizing part 33 of the engagement member 31 pressurizes the one side of the bent belt 2 towards the other side so as to further bend it for fixing the buckle 10. That is, it distinct from the structure in which the belt 2 is fixed through being fastened by a strong force being pinched between the upstanding piece 20 and the pressurizing part 33. Therefore, unlike the related art, it is not necessary to fabricate each part with high precision.

Also, at the time of fixing and moving operation of the buckle 10, a large force is not required to pressurize the pressurizing part 33 by a large force so as to press the belt 2 against the upstanding piece 20 or to release the pressed state. Thus, the fixing and moving operation of the buckle 10 can be easily performed, while suffering less damage for a long period of time and preventing deterioration in the fixing function.

(2) The part for bending the belt 2 is formed by the upstanding piece 20 which stands sloping up towards the direction away from the base part 12 from the base part 12 in the vicinity of the insertion hole 19 to the insertion hole 18. The pressurizing part 33, in the second position, is substantially in the same position as the perpendicular line drawn from the tip of the upstanding piece 20 to the base part 12 or protruded inner side of the upstanding piece than the perpendicular line. Thus, when the engagement member 31 is in the second position, the pressurizing part 33 is to be substantially in the same position as the perpendicular line drawn from the tip of the upstanding piece 20 to the base part 12 or to be protruded inner side of the upstanding piece than the perpendicular line. Therefore, the belt 2 is to be bent in reversed S-shape or Z-shape so that the shift of the buckle 10 can be more surely prevented.

(3) At this time, there is a space formed between the belt 2 and the inner surface of the upstanding piece 20. Therefore, errors, which may be generated in regards to positioning of the upstanding piece 20 and the pressurizing part 33 at the time of fabrication, can be tolerated. Accordingly, unlike the related art, it is not necessary to fabricate each part with high precision also owing to this structure.

(4) Further, the upstanding piece 20 is provided standing to slope against the base 12 at an angle of 35° to 55°. Thus, the thickness of the buckle 10 can be suppressed while maintaining the function of restricting the shift of the buckle 10. In other words, when the angle of the upstanding piece 20 is increased, the bending height (that is, the rising height) of the belt 2 from the base part 12 also increases, thereby increasing the resistance at the time of moving the buckle 10. Thus, the function of restricting the shift of the buckle 10 is improved, however, the thickness of the buckle 10 is increased. Inversely, when the angle of the upstanding piece 20 is decreased, the thickness of the buckle 10 can be decreased, however, the function of restricting the shift of the buckle 10 is deteriorated. On the contrary, the embodiment can achieve both functions as described since the upstanding piece 20 is formed to slope against the base part 12 at the above-described angle.

(5) The tip of the upstanding piece 20 and the tip of the pressurizing part 33 are both formed to be at an angle of 90° or less so that the tips at an acute angle are to be engaged with the belt 2. Therefore, the function of restricting the shift of the buckle 2 can be further improved.

In addition, grooves (dents and protrusions) are formed in the tip 33A of the pressurizing part 33 in the width direction at constant intervals so that the contact resistance against the belt 2 becomes great. Thereby, the function of restricting the shift of the buckle 10 can be further improved.

(6) The engagement member 31 is rotatably supported by the buckle main body 11 in the position between the two insertion holes 18 and 19 of the buckle main body 11. Thus, it can be moved to the first position and the second position by simply rotating the engagement member 31 so that the operation can be easily and smoothly performed.

(7) In the engagement member 31, the pinching part 34 is formed for pinching the belt 2 between the buckle main body 11 and the base part 12 when the engagement part 31 is in the second position. Therefore, when the engagement member 31 is in the second position, the pinching part 34 of the engagement member 31 pinches the belt 2 between with the base part 12 of the buckle main body 11, thereby further increasing the resistance between the belt 2 and the buckle 10. As a result, the function of restricting the shift can be improved.

In addition, grooves (dents and protrusions) are formed in the tip 34A of the pinching part 34 in the width direction at constant intervals, thereby increasing the contact resistance against the belt 2. Therefore, the function of restricting the shift of the buckle 10 can be further improved.

(8) In the engagement member 31, the length adjustor 35 is provided, which is capable of restricting the shift of the inserted belt 3 in an optional position in the longitudinal direction and to which the belt 3 is inserted. Therefore, moving and fixing of the belt 2 in an optional position in the longitudinal direction and adjusting the length of the belt 3 can be achieved by one buckle. As a result, in the conventional rucksack structure, the number of the parts can be reduced so that the cost is reduced while improving the operability.

Furthermore, in the conventional rucksack structure, there is not only a problem regarding the three connectors but also lack of operability since the adjusting operation is required to be performed in the positions of each of the connectors 2C, 3C, and 3D, that is, in three different positions. However, with the buckle of the embodiment, it only requires the operations in two positions thereby solving these problems at the same time.

(9) The length adjustor 35 is composed of at least two insertion holes 36 and 37 provided in the engagement member 31 in the longitudinal direction of the belt 3 with a space in between, to which the belt 3 is inserted. Thus, the belt 3 can be fixed in an optional position through inserting the belt 3 into one of the insertion hole 36, reversing and inserting it into the other insertion hole 37, and then pulling it out to the side of the initial position of the belt 3.

(10) At least one corner of the cross section of the intermediate part 38 between the two insertion holes 36 and 37 formed in the engagement member 31 is formed to be at an angle of 90° or less. In other words, the tips with which the bent belt 3 comes to be in contact are both formed to be at an angle of 90° or less. Therefore, the corners of the tips are to be engaged with the belt 3 so that the function of restricting the shift of the buckle 10 can be further improved.

The present invention is not limited to the buckle according to the above-described embodiment but various modifications such as described below are possible.

The above-described embodiment shows a structure in which the buckle 10 moves along the longitudinal direction of the belt 2. However, inversely, the belt 2 may move against the buckle 10.

The embodiment has been described by referring to the case where it is applied to a rucksack. However, it is not limited to this but can be applied in other use such as a buckle which can be moved in the longitudinal direction of a web-like material and can be fixed in an optional position.

Figure 7:
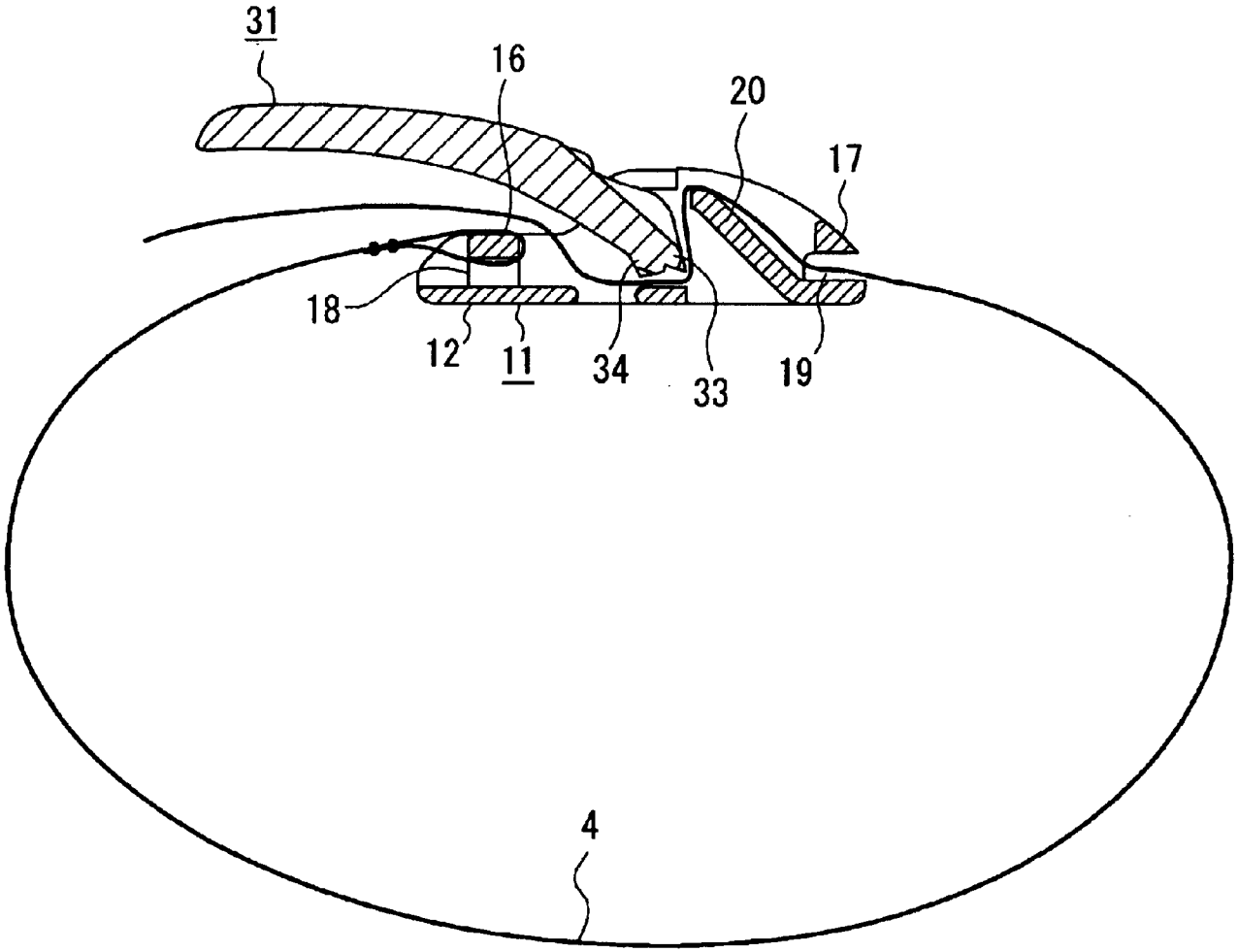
FIG. 7 is a cross section showing another embodiment of the present invention.

For example, as shown in FIG. 7, it can be used as a buckle 40 for a belt. The buckle 40 for a belt has the same structure as the buckle 10 of the above-described embodiment except that the length adjustor 35 provided in the engagement member 31 is omitted and one end part of a belt 4 is fixed to a connecting bar 16.

When using, one end of the belt 4 is fixed to the connecting bar 16 of the buckle main body 11. And, the other end of the belt 2 is inserted to the insertion hole 19, brought along the upstanding piece 20, put through between the pressurizing part 33 of the engagement member 31, and then pulled out from the space between the engagement member 31 and the buckle main body 11.

In this state, the length of the belt 4 can be shortened through pulling the other end of the belt 4. When the engagement member 31 is rotated in an optional position, the pressurizing part 33 is inserted inside the upstanding piece 20. Thus, the bent part of the belt 2 is to be further bent thereby restricting the shift of the belt 4. In other words, it is fixed in the position.

Therefore, the effects (1) to (7) described above can be achieved even when the present invention is used as a buckle for a belt.

Further, in the embodiment, the engagement member 31 is rotatably supported against the buckle main body 11. However, the same effects can be expected even when the engagement member 31 is slidably supported to the buckle main body 11, that is, provided to slide in parallel along the base part 12 of the buckle main body 11 so as to be inserted into the inner side of the upstanding piece 20.

In the above-described embodiment, the insertion holes 18 and 19, to which the belt 2 is inserted, are provided between the connecting bars 16, 17 and the base part 12. These holes are not necessarily the completely closed holes but may be holes like a groove in which one part is open. In short, the shape is not limited as long as it can guide the belt 2 movably in the longitudinal direction in a prescribed position of the base part 12.

Further, in the above-described embodiment, the upstanding piece 20 is to stand up sloping against the base part 12 at an angle of 35° to 55°. However, it is not necessary for the upstanding piece 20 to be sloping but may be in a form in which it is stands from the base part 12 substantially at a right angle and extends in parallel with the base part 12 (extends in parallel towards the insertion hole 18).

Furthermore, in the above-described embodiment, when the engagement member 31 is in the second position, the pressurizing part 33 is to be substantially in the same position as the perpendicular line drawn from the tip of the upstanding piece 20 to the base part 12 or protruded to the inner side of the upstanding piece than the perpendicular line. However, it is not necessarily limited to this. The pressurizing part 33 may be in the position slightly shifted to the opposite side of the upstanding piece 20 with respect to the perpendicular line drawn from the tip of the upstanding piece 20 to the base part 12.

Moreover, in the above-described embodiment, the length adjustor 35 with two insertion holes 36 and 37 is provided in the engagement member 31. However, the mechanism (structure) of the length adjustor 35 is not limited to the above-described embodiment. Other structure may be applicable as long as it is the structure which can fix the belt 3 to be capable of adjusting the length.

The entire disclosure of Japanese Patent Application No.2002-74433 filed on Mar. 18, 2002 including specification, claims, drawings and summary are incorporated herein by reference in its entirety.

What is claimed is:

1. A buckle capable of being moved in a longitudinal direction of a web-like material and being fixed in an optional position, comprising a first member and a second member which is provided displaceable in the first member, wherein the first member comprises: a base part; at least two insertion parts provided in the base part with a space in between to which the web-like material is inserted; and a bending part provided in between the two insertion parts for bending the web-like material in a direction away from the base part, and the second member is displaceable to a first position where the buckle can be moved against the web-like material and to a second position where the buckle can be fixed to the web-like material, and comprises a pressurizing part for pressurizing one side of the web-like material in a bent state towards the other side so as to obtain a further bent state in the second position;

wherein the bending part is composed of an upstanding piece which stands up sloping towards a direction away from the base part as it reaches the other insertion part from the base part in the vicinity of one of the insertion parts; and the pressurizing part, in the second position, is to be substantially in the same position as a perpendicular line drawn from the tip of the upstanding piece to the base part or to be protruded to inner side of the upstanding piece than the perpendicular line.

2. A buckle according to claim 1, wherein the upstanding piece stands up sloping against the base part at an angle of 35° to 55°.

3. A buckle according to claim 1, wherein the tip of the upstanding piece and the tip of the pressurizing part are formed at an angle of 90° or less.

4. A buckle according to claim 1, wherein the second member is rotatably supported by the base part in between the two insertion parts of the first member.

5. A buckle according to claim 4, wherein the second member comprises a pinching part for pinching the web-like material between with the base part of the first member when the second member comes to be in the second position.

6. A buckle capable of being moved in a longitudinal direction of a web-like material and being fixed in an optional position, comprising a first member and a second member which is provided displaceable in the first member, wherein the first member comprises: a base part; at least two insertion parts provided in the base part with a space in between to which the web-like material is inserted; and a bending part provided in between the two insertion parts for bending the web-like material in a direction away from the base part, and the second member is displaceable to a first position where the buckle can be moved against the web-like material and to a second position where the buckle can be fixed to the web-like material, and comprises a pressurizing part for pressurizing one side of the web-like material in a bent state towards the other side so as to obtain a further bent state in the second position;

wherein the second member comprises a length adjusting means capable of restricting shift of the inserted other web-like material in an optional position in a length direction, to which other web-like material than the web-like material is inserted.

7. A buckle according to claim 6, wherein the length adjusting means is composed at least two insertion parts provided in the second member with a space in between in a longitudinal direction of the other web-like material, to which the other web-like material is inserted.

8. A buckle according to claim 6, wherein at least one corner of cross section in a part between the two insertion parts formed in the second member makes an acute angle.

9. A buckle according to claim 6, wherein the second member is rotatably supported by the base part in between the two insertion parts of the first member.

10. A buckle according to claim 9, wherein the second member comprises a pinching part for pinching the web-like material between with the base part of the first member when the second member comes to be in the second position.

* * * * *